US005390616A

United States Patent [19]

Roth

[11] Patent Number: 5,390,616

[45] Date of Patent: Feb. 21, 1995

[54] DOCK MOUNTED SMALL BOAT LIFTING SYSTEM

[76] Inventor: Henry Roth, 714 Hurlock, Spring, Tex. 77373

[21] Appl. No.: 78,832

[22] Filed: Jun. 21, 1993

[51] Int. Cl.[6] ..... B63C 3/06

[52] U.S. Cl. ..... 114/44; 405/3

[58] Field of Search ..... 405/3; 114/44, 45, 51; 187/27

[56] References Cited

U.S. PATENT DOCUMENTS

| | | | |
|---|---|---|---|
| 1,278,215 | 9/1918 | Rawlins | 114/51 |
| 2,384,580 | 9/1945 | Wertheimer | 114/51 |
| 2,529,948 | 11/1950 | Jones | 405/3 |
| 3,073,125 | 1/1963 | Pearlson | 405/3 |
| 3,077,742 | 2/1963 | Brown | 405/3 |
| 4,087,979 | 5/1978 | Pearlson | 405/3 |
| 5,051,027 | 9/1991 | Horton | 114/44 |
| 5,178,488 | 1/1993 | Stokoe et al. | 405/3 |

*Primary Examiner*—Sherman Basinger
*Attorney, Agent, or Firm*—Alan R. Thiele

[57] ABSTRACT

A small boat lifting device for use between two substantially parallel docks includes two substantially cylindrical longitudinal cable winding reels. Attached to the substantially cylindrical longitudinal cable winding reels are flexible cables which are in turn are secured to a small boat lifting cradle. As the substantially cylindrical longitudinal cable winding reels are rotated the flexible cables are wound therearound thus causing the small boat to be lifted from the water into the space between the two substantially parallel docks.

22 Claims, 2 Drawing Sheets

DOCK MOUNTED SMALL BOAT LIFTING SYSTEM

BACKGROUND OF THE INVENTION

The present invention relates to watercraft lifting systems; more particularly, the present system pertains to watercraft lifting systems which are mounted between substantially parallel docks between which small watercraft are typically stored. Such arrangements of docks are often found on lakes, inlets, marinas and canals or other waterways used by small recreational watercraft.

In many locations where small watercraft are stored it has become desirable and sometimes necessary to lift these small watercraft out of the water. A variety of methods are being used to meet this need.

In the following description the word "boat" will be used; however, it will be understood that this word will be meant to include such other watercraft as Jet-Skis ®, pontoon boats and the like.

Typically prior art small boat lifting systems incorporate a boat cradle which is placed between the substantially parallel dock members. The small boat is first caused to rest upon the boat cradle. Then the boat cradle is guided upwardly to lift the boat from the water by a guide assembly mounted within the substantially parallel dock members. The actual lifting of the boat cradle from the water is accomplished by flexible cables. These flexible cables pass around a complex system of pulleys and are then wound around a cable reel located at the head of the dock assembly. Such boat lifting systems place inordinately large stresses on the cables. It has been found that such cables repeatedly fail because of the stresses caused by high boat loads and the many twists and turns taken by the cables before being wound on a cable reel. In addition, such boat lifting systems are also expensive because of the need to install a guide assembly in the docks on either side of the boat to guide the boat lifting cradle in its travel upwardly out of the water.

There is therefore a need in the art to provide a boat lifting system which is simple, inexpensive and reliable. Such boat lifting system should be easy to use and easy to install without requiring major disassembly or reconstruction of the docks between on which it is to be installed.

A prior art search was done and the following patents were identified; U.S. Pat. Nos. 3,073,125, 3,114,246, 3,276,211, 4,329,082, 4,686,920.

Exemplary of systems using complex cable arrangements which place large forces on such cables and cause quick wear of cables are those shown in U.S. Pat. Nos. 3,114,246 and 4,329,082.

Systems designed for larger boats which employ flexible cables are found in U.S. Pat. Nos. 3,073,125 and 3,276,211.

U.S. Pat. No. 4,686,920 illustrates an extremely complex cable system used for lifting small boats from the water. Because of the number of twists and turns made by the cable in the system disclosed in U.S. Pat. No. 4,686,920 it is anticipated that, while operative, this system is subject to frequent failure because of the stresses put on the lifting cables.

SUMMARY OF THE INVENTION

There is provided by the Dock Mounted Small Boat Lifting System of the present invention a simple, inexpensive and reliable method for lifting a small boat out of the water when the small boat is located between substantially parallel docks.

A dock mounted system for lifting a small boat out of the water when the small boat is located on a boat lifting cradle between substantially parallel docks includes a plurality of flexible cables which extend out of the water from the boat lifting cradle. The flexible cables proceed to a pair of substantially cylindrical longitudinal cable winding reels. One substantially cylindrical longitudinal cable winding reel is rotatably mounted to each of the parallel dock members located on either side of the small boat.

By rotating the substantially cylindrical longitudinal cable winding reels the boat cradle, with the boat positioned thereupon, is lifted upwardly from the water.

Key to the operation of the small boat lifting system of the present invention is rotatably mounting the substantially cylindrical longitudinal cable winding reels to the dock members. This is accomplished by a plurality of substantially cylindrical guide bearings firmly attached to each dock member. The firm attachment of the guide bearings to the substantially parallel dock members is accomplished by use of angle irons or a Z-section beam.

A drive system is used to rotate the substantially cylindrical longitudinal cable winding reels within the guide bearings. The drive system may rotate the substantially cylindrical longitudinal cable winding reels directly or may accomplish such task through a speed reduction gear box.

When it is desired to return the boat to the water the direction of rotation of the drive system is reversed so that the boat is lowered into the water on the boat lifting cradle as the cable members unwind from the substantially cylindrical longitudinal cable winding reels.

BRIEF DESCRIPTION OF THE DRAWINGS

A better understanding of the Dock Mounted Small Boat Lifting System of the present invention may be had by reference to the drawings wherein.

DESCRIPTION OF THE EMBODIMENTS

Figure 1:
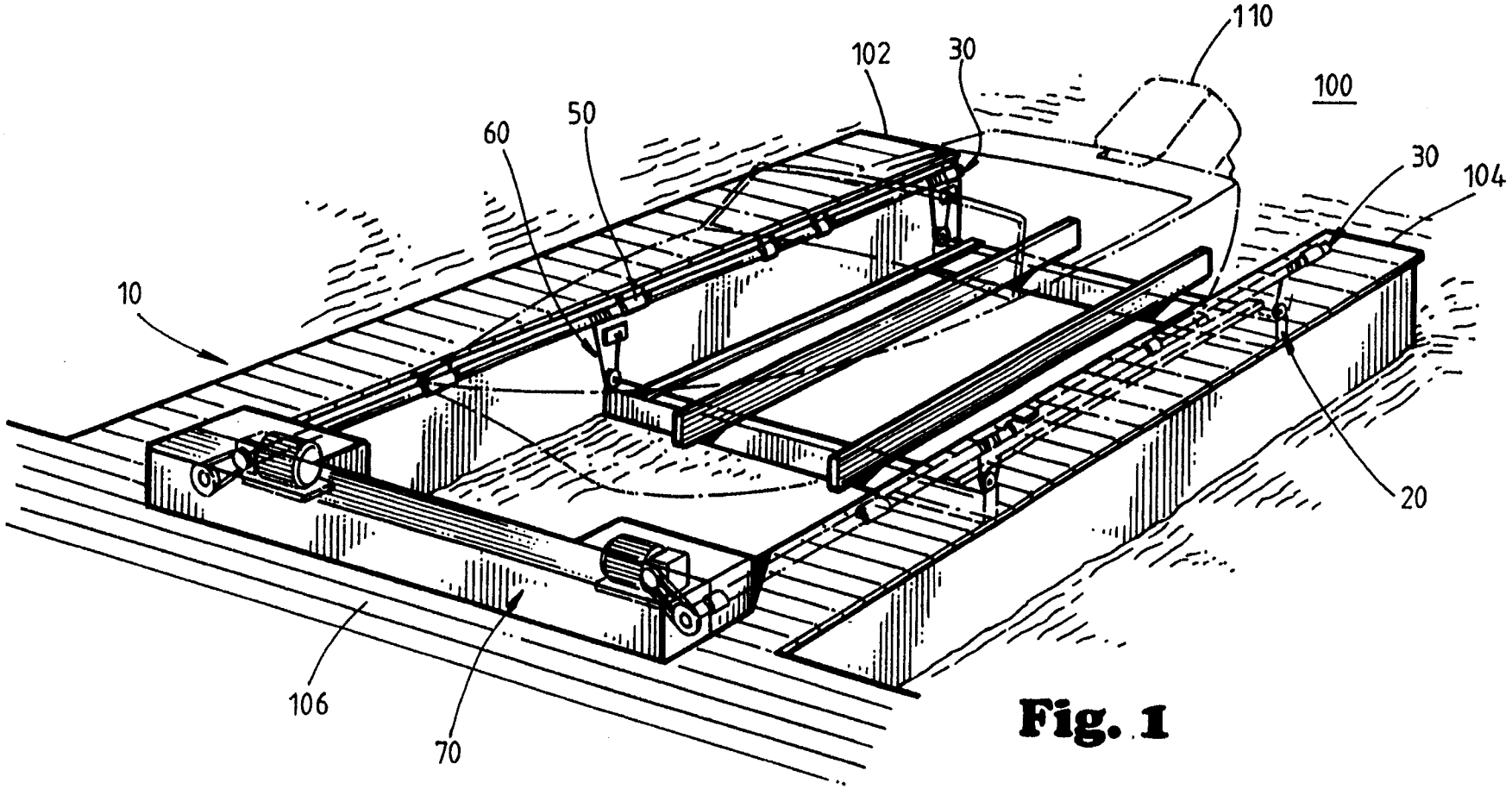
FIG. 1 is a perspective view of the dock mounted small boat lifting system of the present invention with the small boat shown in phantom.

A initial understanding of the Dock Mounted Small Boat Lifting System 10 of the present invention may be had by reference to FIG. 1 which illustrates the various subsystems incorporated into the present invention.

The environment in which the system 10 of the present invention is used is the space between two docks 102 and 104 which extend in a substantially parallel manner from land into water 100. Typically such dock arrangements are found in lakes, inlets, marinas or canals where recreational small boats 110 are typically stored.

Located between docks 102 and 104 and in water 100 is boat cradle assembly 20. It is this boat cradle assembly 20 upon which a small boat 110 is positioned and upon which small boat 110 is lifted from water 100.

Attached to boat cradle assembly 20 is cable assembly 60. Cable assembly 60 bears the weight of boat cradle assembly 20 and thus actually imparts the substantially vertical force which causes boat cradle assembly 20 to be lifted from water 100.

Causing cable assembly 60 to lift cradle assembly 20 from water 100 is substantially cylindrical longitudinal cable winding reel assembly 30 which extends substantially the length of the boat cradle assembly 20. The substantially cylindrical longitudinal cable winding reel assembly 30 is rotatably mounted to each of the substantially parallel docks 102 and 104. As may be seen by further reference to FIG. 1 substantially cylindrical longitudinal cable winding reel assembly 30 extends substantially the length of the small boat 110. This rotatable mounting of substantially cylindrical longitudinal cable winding reel assembly 30 is accomplished by the use of guide bearing assembly 50 affixed to docks 102 and 104 by angle irons 54 or a Z-shaped beam section. While angle irons 54 are shown in the preferred embodiment and a X-shaped beam section has been suggested, those of ordinary skill in the art will realize that a variety of different structural arrangements may be used to rotatably mount reel assembly 30 to docks 102 and 104. Such structural arrangements shall fall within the scope of the present invention.

Empowering the substantially cylindrical longitudinal cable winding reel assembly 30 is drive system 70 which may be located at the head end 106 of the dock.

A more thorough description of each subsystem of the boat lifting system 10 of the present invention follows.

Figure 2:
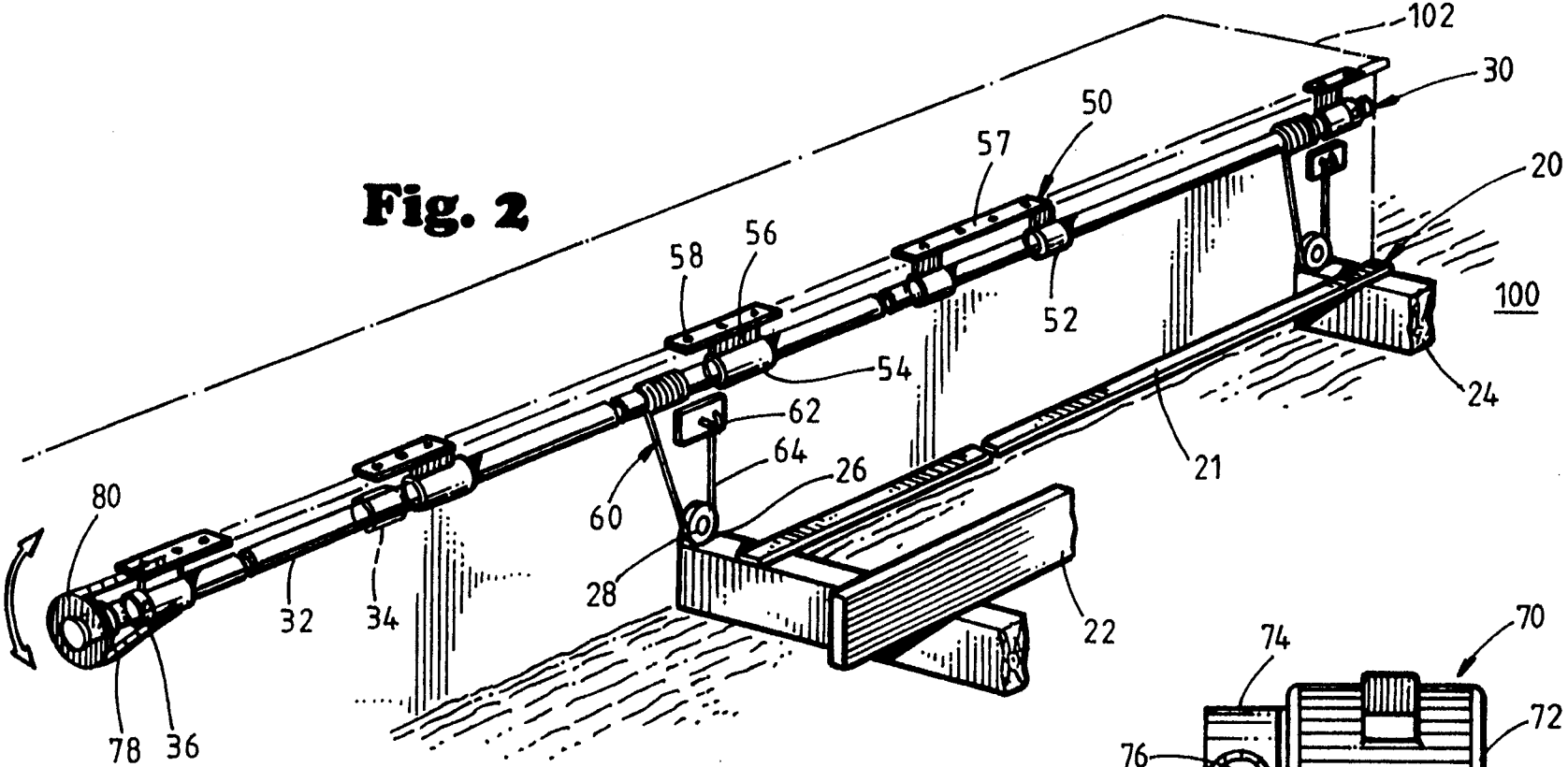
FIG. 2 is a perspective view of one side of the dock mounted small boat lifting system of the present invention.
Figure 3:
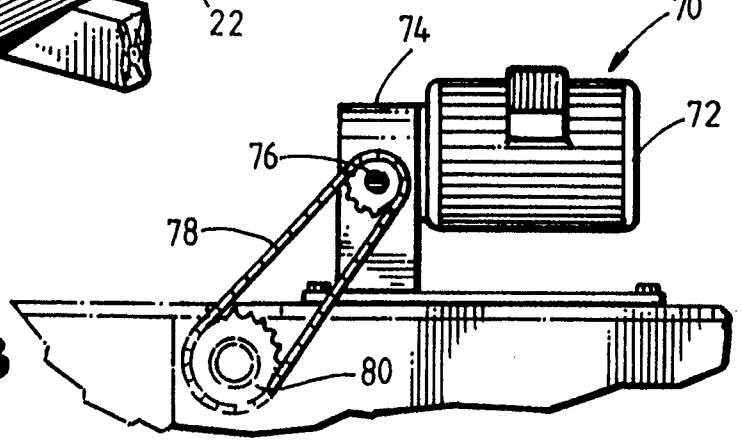
FIG. 3 is an elevational view of the drive system.

In FIG. 2 it may be seen that boat cradle assembly 20 includes at least two lifting beams 24 which extend in a substantially perpendicular direction between dock members 102 and 104. Lifting beams 24 are both sized to fit between dock members 102 and 104 and to allow for lateral movement between dock members 102 and 104. It is essential that the lifting beams 24 be of sufficient length so that they may travel upward between dock members 102 and 104 without getting caught on the sides of dock members 102 and 104. There is no need to use guide channels in the sides of dock members 102 and 104 to control the upward travel of beams 24.

Spacing lifting beams 24 apart is optional spacer 21 which is affixed to each lifting beam 24. The actual surface upon which boat 110 rests is provided by longitudinal support beams 22. Longitudinal support beams 22 cradle the hull of boat 110 as it is positioned on cradle assembly 20. If desired longitudinal support beams 22 may be padded to protect the bottom of the hull of boat 110. Support beams 22 may also be shaped to conform to the hull of boat 110 if the hull of boat 110 has a particularly unique shape such as a multiple-V.

At the end of lifting beams 24 cable attachment means 26 are provided for elevating lifting beams 24 from water 100. As shown in the embodiment in FIG. 2 pulleys 28 are mounted to the ends of lifting beams 24. It will be obvious to those of ordinary skill in the art that it is also possible to attach cables 64 directly to the ends of lifting beams 24. Such attachment may be accomplished by a variety of different methods to include using knots, clamps, welded connections and the like.

The force required to lift cradle assembly 20 from water 100 is provided by cable assembly 60. As shown in FIG. 2, cable 64 is attached to the side of dock 102 or 104 at 62. Cable 64 then passes through pulley 28 and then to substantially cylindrical longitudinal cable winding reel assembly 30. Various combinations of cables and pulleys can be used if it is necessary to increase the mechanical advantage of the boat lifting system. Such combinations of pulleys with cable system 60 shall fall within the scope of the present invention.

Substantially cylindrical longitudinal cable winding reel assembly 30 imparts the force on the cable assembly 60 to lift the boat cradle assembly 20 from water 100. Substantially cylindrical longitudinal cable winding reel assembly 30 includes longitudinal tube or pipe members 32 which act as cable winding reels. It will be understood by those of ordinary skill in the art that while pipe or tube members 32 are used in the preferred embodiment it may be possible to use solid rods or tubing having flat sides in place of pipe members 32.

Located on pipe member 32 and shown in phantom are optional intermittent stop collars 36. Intermittent stop collars 36 may be placed at several locations along pipe members 32. These stop collars 36 maintain the longitudinal position of pipe members 32 with respect to dock members 102 and 104. Optionally, pipe members 32 may also be machined to include guide grooves (not shown) which will assist in guiding cable 64 onto pipe members 32. If desired guiding knives (not shown) extending outwardly from the surface of pipe member 32 may be used in place of or in addition to grooves.

Substantially cylindrical longitudinal cable winding reel assembly 30 is affixed to dock members 102 and 104 by use of a plurality guide bearing assemblies 50. Guide bearing assemblies 50 include a substantially cylindrical pipe section 52. Pipe section 52 is welded to the throat section of a short piece of angle iron 54 in the preferred embodiment.

Attaching support angle irons 54 to docks 102 and 104 are mounting angles 56 which are affixed to support angle irons 54. If desired a Z section beam or any other convenient structural beam section may be used in place of angle irons 54 and 56.

Mounting angles 56 are affixed to the dock by mounting plates 57 which may be attached to the dock by bolts 58 or any other convenient mounting means. Those concerned about the appearance of docks 102 and 104 may wish to cover the top of bearing assemblies 50 or mount bearing assemblies 50 to a beam affixed to the side of docks 102 and 104.

Shown in the preferred embodiment are five guide bearing assemblies 50 on each dock. While five guide bearing assemblies 50 are shown in the preferred embodiment it will be understood that a minimum of two guide bearing assemblies 50 may be used on each dock with the system 10 of the present invention. For stability it is recommended that additional guide bearing assemblies 50 be used along the length of the substantially cylindrical longitudinal cable winding reel assembly 30. The longer and heavier the boat to be lifted, the more guide bearing assemblies 50 that should be used. Those of ordinary skill in the art will realize that by placing guide bearing assemblies 50 near where cables 64 are wound onto reel system 30 will shorten the length of cantilever loadings within pipe member 32.

While a close tolerance fit is not essential between pipe 32 and pipe sections 52 of guide bearing assembly 50 it has been found that it is helpful to include lubrication between pipe 32 and pipe sections 52. Such lubrication may be ideally provided by grease fittings (not shown) passing through drilled holes in pipe section 52. It is also possible to manually lubricate the surface between pipe 32 and pipe section 52 with a common grease gun. Other types of friction reduction systems may be used such as providing Teflon® within pipe section 52.

Cradle assembly 20 is lifted from water 100 by rotating each substantially cylindrical longitudinal cable winding reel assembly 30 such that cable assembly 60 is wound thereupon. Turning of substantially cylindrical longitudinal cable winding reel assembly 30 is accomplished by mechanically connecting pipes 32 to a mechanical drive system 70.

Drive system 10 includes a motor 72, preferably an electric motor. As shown in the embodiment illustrated in FIG. 1, motor 72 is attached to each of the two substantially cylindrical longitudinal cable winding reel assemblies 30. It is also possible to use a single motor with a complex drive system which drives each of the substantially cylindrical longitudinal cable winding reel assemblies 30.

Attached to motor 72 is a speed reduction gearbox 74. Extending from the speed reduction gearbox 74 is a shaft mounted sprocket 76. Traveling around sprocket 76 is a chain 78 which drives sprocket 80. Sprocket 80 is attached to pipe 32. Thus when sprocket 76 is rotated chain 78 causes sprocket 80 to rotate which in turn rotates pipe 32 within pipe sections 52. The rotation of pipes 32 causes cables 64 to wrap around pipe 32. This wrapping of cables 64 around pipe 32 shortens the operative length of cable 64 and thus causes boat cradle assembly 20 to be lifted from water 100. When boat 110 is located on cradle assembly 20 boat 110 travels upwardly with cradle 20 and thus is lifted from the water 100. Internal motion brakes within drive system 70 work against gravity to keep boat 110 out of water 100. Return of boat 110 to water 100 is accomplished by simply allowing drive assembly 70 to rotate in the opposite direction. Cables 64 thus unwind from pipes 32 and cradle assembly 20 is lowered into water 100.

Operation

The Dock Mounted Small Boat Lifting System of the present invention 10 may be easily operated by assuring that cradle assembly 20 is located within water 100 at a sufficient depth so that boat 110 may by positioned thereupon. Once boat 110 has been moved into position over cradle assembly 20 the drive system 70 of boat lifting system 10 of the present invention is activated. Activation of drive system 70 causes substantially cylindrical longitudinal cable winding reel assemblies 30 to rotate. The rotation of substantially cylindrical longitudinal cable winding reel assemblies 30 along each dock 102 and 104 causes cables 64 attached to the boat cradle assembly 20 to be in tension. This cable tension is continued by the turning of the substantially cylindrical longitudinal cable winding reel assemblies 30. This cable tension causes cradle assembly 20 to be lifted from the water 100. As the cradle assembly 20 is lifted from the water 100 the longitudinal support beams 22 come into contact with the lower portion of the hull of boat 110 and thus boat 110 is lifted from water 100. In many conditions it is desirable to lift boat 110 entirely out of water 100. In other conditions it is desirable to lift boat 110 only partially out of the water, but to leave it supported on boat cradle assembly 20.

There is thereby provided by the present invention a small boat lifting system 10 for mounting between two substantially parallel docks. This boat lifting system is easy to use, inexpensive, and requires a minimum number of parts and maintenance.

I claim:

1. A system for lifting a small boat out of a body of water, said small boat lifting system comprising:

a pair of dock members extending from land into the body of water;

a boat cradle assembly constructed and arranged to be submersible in the body of water and to support the small boat by contact with the hull of the small boat;

a plurality of flexible cables extending substantially upwardly from said boat cradle assembly, said plurality of flexible cables engaging said boat cradle assembly to bear the weight of the small boat and the boat cradle assembly;

two individual substantially cylindrical longitudinal cable winding reels each being rotationally mounted to one of said pair of dock members on either side of the small boat, said substantially cylindrical longitudinal cable winding reels extending substantially the length of the small boat;

a drive system constructed and arranged to rotate each of said individual substantially cylindrical longitudinal cable winding reels;

means for affixing said plurality of flexible cables to said individual substantially cylindrical longitudinal cable winding reels, said means for affixing said plurality of flexible cables to said individual substantially cylindrical cable winding reels causing said flexible cables to wind around said individual substantially cylindrical longitudinal cable winding reels when said individual substantially cylindrical longitudinal cable winding reels are rotated by said drive system;

whereby empowerment of said drive system will cause said individual substantially cylindrical longitudinal cable winding reels to rotate which will cause said flexible cables to wind around said individual substantially cylindrical longitudinal cable winding reels which will in turn lift said cradle member thus lifting the small boat out of the water between said dock members.

2. The system as defined in claim 1 whereby the ends of said flexible cables are affixed to said boat cradle assembly.

3. The system as defined in claim 1 wherein one end of said flexible cables is affixed to each of said dock members and said flexible cables engage said boat cradle assembly by passing through a pulley mounted to said boat cradle assembly.

4. The system as defined in claim 1 wherein said individual substantially cylindrical longitudinal cable winding reels are mounted within a plurality of substantially cylindrical guide bearings affixed to each of said dock members.

5. The system as defined in claim 4 wherein said substantially cylindrical guide bearings are mounted to a structural beam section.

6. The system as defined in claim 5 wherein said structural beam section is firmly affixed to each of said dock members.

7. The system as defined in claim 4 wherein each individual substantially cylindrical longitudinal cable winding reel includes stop members to prevent longitudinal movement of said individual substantially cylindrical longitudinal cable winding reels with respect to said substantially cylindrical guide bearings.

8. The system as defined in claim 1 wherein each individual substantially cylindrical longitudinal cable winding reel is driven by a motor.

9. The system as defined in claim 8 wherein each motor is connected to a speed reduction gear box which in turn drives each of said individual substantially cylindrical longitudinal cable winding reels.

10. A method for lifting a small boat from the water on a boat lifting cradle when said small boat and said boat lifting cradle are located between two substantially parallel docks which extend into the water from land, said method comprising the steps of:

affixing a plurality of flexible cable members to the boat lifting cradle;

lowering the boat lifting cradle to a depth into the water between the docks so that the small boat may pass over the boat lifting cradle;

moving the small boat over the boat lifting cradle;

rotationally mounting one substantially cylindrical longitudinal cable winding reel to each of the docks so that said substantially cylindrical longitudinal cable winding reels extend substantially the length of the small boat;

affixing said cable members to each of said substantially cylindrical longitudinal cable winding reels;

rotating each one of said substantially cylindrical longitudinal cable winding reels so that said cable members wind therearound;

continuing the rotation of each of said substantially cylindrical longitudinal cable winding reels until said small boat and said boat lifting cradle are lifted from the water into the space between the docks.

11. The method as defined in claim 10 wherein each of said substantially cylindrical longitudinal cable winding reels are located within a plurality of substantially cylindrical guide bearings.

12. The method as defined in claim 11 wherein said substantially cylindrical guide bearings are mounted to each dock.

13. A system for raising a cable lifted boat cradle from the water when said cable lifted boat cradle is located between two docks which extend from land, said system comprising:

a pair of substantially cylindrical longitudinal cable winding reels, one substantially cylindrical longitudinal cable winding reel rotationally mounted to each dock on either side of the cable lifted boat cradle and extending substantially the length of the boat cradle;

a drive system constructed and arranged to rotate each of said substantially cylindrical cable winding reels;

means for affixing the flexible cables to each of said substantially cylindrical longitudinal cable winding reels, said means for affixing causing the flexible cables to wind around said substantially cylindrical cable winding reels when each of said substantially cylindrical longitudinal cable winding reels are rotated by said drive system;

whereby empowerment of said drive system will cause each of said substantially cylindrical longitudinal cable winding reels to rotate which will cause said flexible cables to wind around each of said substantially cylindrical longitudinal cable winding reels which will in turn lift said boat cradle between docks thus lifting the small boat out of the water.

14. The system as defined in claim 13 wherein said substantially cylindrical longitudinal cable winding reels are mounted within a plurality of substantially cylindrical guide bearings.

15. The system as defined in claim 14 wherein said substantially cylindrical guide bearings are mounted to structural beam sections.

16. The system as defined in claim 15 wherein said structural beam sections are firmly affixed to the docks.

17. The system as defined in claim 15 wherein each substantially cylindrical longitudinal cable winding reel includes a stop member to prevent longitudinal movement within said substantially cylindrical guide bearings.

18. The system as defined in claim 13 wherein each substantially cylindrical longitudinal cable winding reel is driven by a motor.

19. The system as defined in claim 19 wherein each motor is connected to a speed reduction gear box which in turn drives said substantially cylindrical longitudinal cable winding reels.

20. A method for raising a cable lifted boat cradle from the water when said cable lifted boat cradle is located between two docks which extend from land into the water, said method comprising the steps of:

rotationally mounting each member of a pair of substantially cylindrical longitudinal cable winding reels to each of the docks on either side of the cable lifted boat cradle and extending substantially the length of the boat cradle;

affixing flexible cables to each of said substantially cylindrical cable winding reels;

rotating each of said substantially cylindrical longitudinal cable winding reels so that said cables wind therearound;

continuing the rotation of each of said substantially cylindrical cable winding reels until the boat cradle is lifted from the water into the space between the docks.

21. The method as defined in claim 20 wherein each substantially cylindrical longitudinal cable winding reel is located within a plurality of substantially cylindrical guide bearings.

22. The method as defined in claim 21 wherein each substantially cylindrical guide member is mounted to each dock.

* * * * *